US005211460A

United States Patent [19]

Liu

[11] Patent Number: 5,211,460

[45] Date of Patent: May 18, 1993

[54] SHOE CLOSETS

[76] Inventor: Shih-Ying Liu, 5Fl., No. 2, Alley 7, Lane 298, Chinhsin St., Chungho, Taipei Hsien, Taiwan

[21] Appl. No.: 737,241

[22] Filed: Jul. 29, 1991

[51] Int. Cl.[5] ..... A47B 57/04

[52] U.S. Cl. ..... 312/306; 211/34; 211/121

[58] Field of Search ..... 312/306, 312, 236, 321.5, 312/268; 211/34, 38, 121, 187

[56] References Cited

U.S. PATENT DOCUMENTS 2,122,680 7/1938 Dart ..... 312/321.5 X
2,125,619 8/1938 Parent ..... 312/268 X
4,008,807 2/1977 Phillips ..... 211/34
4,753,496 6/1988 Bussard ..... 312/236
4,912,359 3/1990 Offutt et al. ..... 312/306

*Primary Examiner*—James R. Brittain
*Assistant Examiner*—Brian K. Green
*Attorney, Agent, or Firm*—Zarley, McKee, Thomte, Voorhees, & Sease

[57] ABSTRACT

A shoe closet comprises a compartment for the storage and retrieval of shoes, a number of shoe-plate modules on which shoes are placed, a conveyor assembly for carrying shoes to a desired position, and a driving unit for driving the conveyor assembly. The conveyor assembly includes a first conveyor device disposed at an inner edge of the compartment for an upward movement of the shoe-plate module and a second conveyor device disposed at an outer edge of the compartment for a downward movement of the shoe-plate module.

7 Claims, 8 Drawing Sheets

SHOE CLOSETS

BACKGROUND OF THE INVENTION

The present invention relates to shoe closets, and more particularly to improved shoe closets having conveyor means driven by a motor for automatically conveying shoes to a desired position.

In shoe closets of a multi-door type, it is quite inconvenient for users to locate certain shoes, because one has to possibly open numerous doors to search for the shoes. In addition, the user has to possibly open numerous doors to seek a space for shoes to be stored.

The present invention provides improved shoe closets to mitigate and/or obviate the aforementioned problems.

SUMMARY OF THE INVENTION

It is an object of the present invention to provide a shoe closet in which a plurality of shoe-plate modules are provided for putting shoes thereon.

It is another object of the present invention to provide a shoe closet, wherein the shoe-plate module on which a certain pair of shoes is put is pulled outward and conveyed downward by a pair of conveyor means when the certain pair of shoes is required by a user.

It is still another object of the present invention to provide a shoe closet, wherein the shoe-plate module is moved upward by another pair of conveyor means to a storage position.

It is yet another object of the present invention to provide a shoe closet, wherein a foldable slipper shelf is used for storage and retrieval of slippers.

These and additional objects, if not set forth specifically herein, will be readily apparent to those skilled in the art from the detailed description provided hereunder, with appropriate reference to the accompanying drawings.

BRIEF DESCRIPTION OF THE DRAWINGS

FIG. 7 is a view similar to FIG. 6A, wherein the control plate is in its upper position in FIG. 7;

DETAILED DESCRIPTION OF THE PREFERRED EMBODIMENTS

Figure 1:
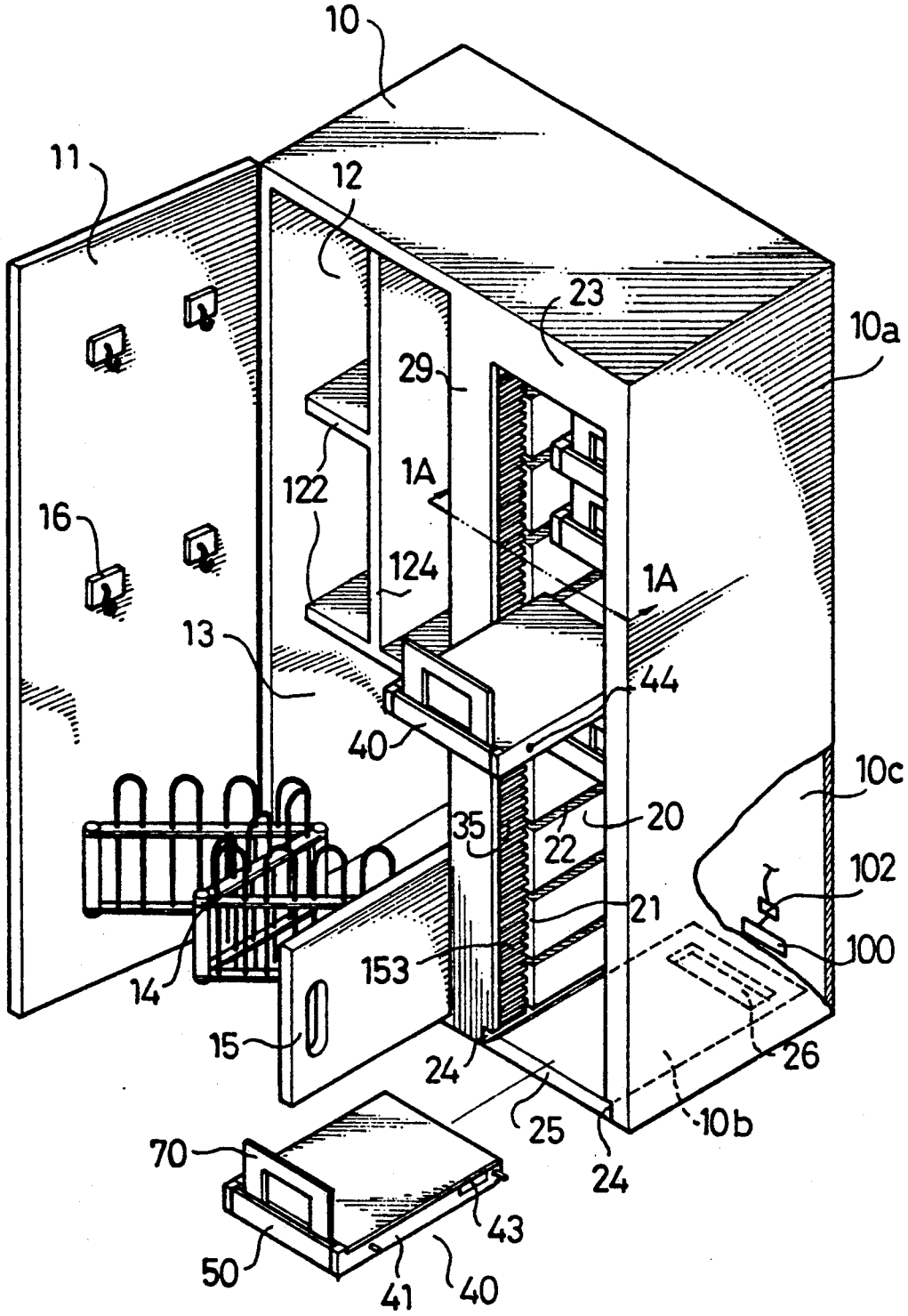
FIG. 1 is a perspective view of a shoe closet in accordance with the present invention in an open status.

Referring to the drawings and initially to FIG. 1, a shoe closet 10 according to the present invention generally comprises two compartments: a right compartment 20 and a left compartment (not labeled) including an upper compartment 12 and a lower compartment 13. The upper compartment 12 is divided into several subcompartments by spaced partitions for accommodating objects therein. In this embodiment, the upper compartment 12 is divided into three subcompartments by two horizontal partitions 122 and a vertical partition 124. The lower compartment 13 is used as a space for accommodating slippers therein.

A door 11 is hinged to a left plate (not labeled) of the shoe closet 10 to open or close the left compartment. A foldable slipper shelf 14 is hinged to an inner side of the door 11 at a first end thereof, and is hinged to an inner side of a plate 15 at a second end thereof. As can be conceived by this figure, the slipper shelf 14 is folded and received in the lower compartment 13 when the door 11 is in a closed status. The slipper shelf 14 is drawn out and unfolded when the door 11 is opened. In addition, the plate 15 is slidable along a longitudinal axis thereof, e.g., the plate 15 can be pulled outward along a grooved track (not shown) provided on a bottom plate of the lower compartment 13, such that the whole slipper shelf 11 is utilizable for storage and retrieval of slippers. Reversely, a user can push the plate 15 inward, such that only part of the slipper shelf 14 is utilizable for storage and retrieval of slippers. Optionally, a plurality of hooks 16 can be applied to an inner wall of the door 11 for hooking objects thereon.

Figure 1A:
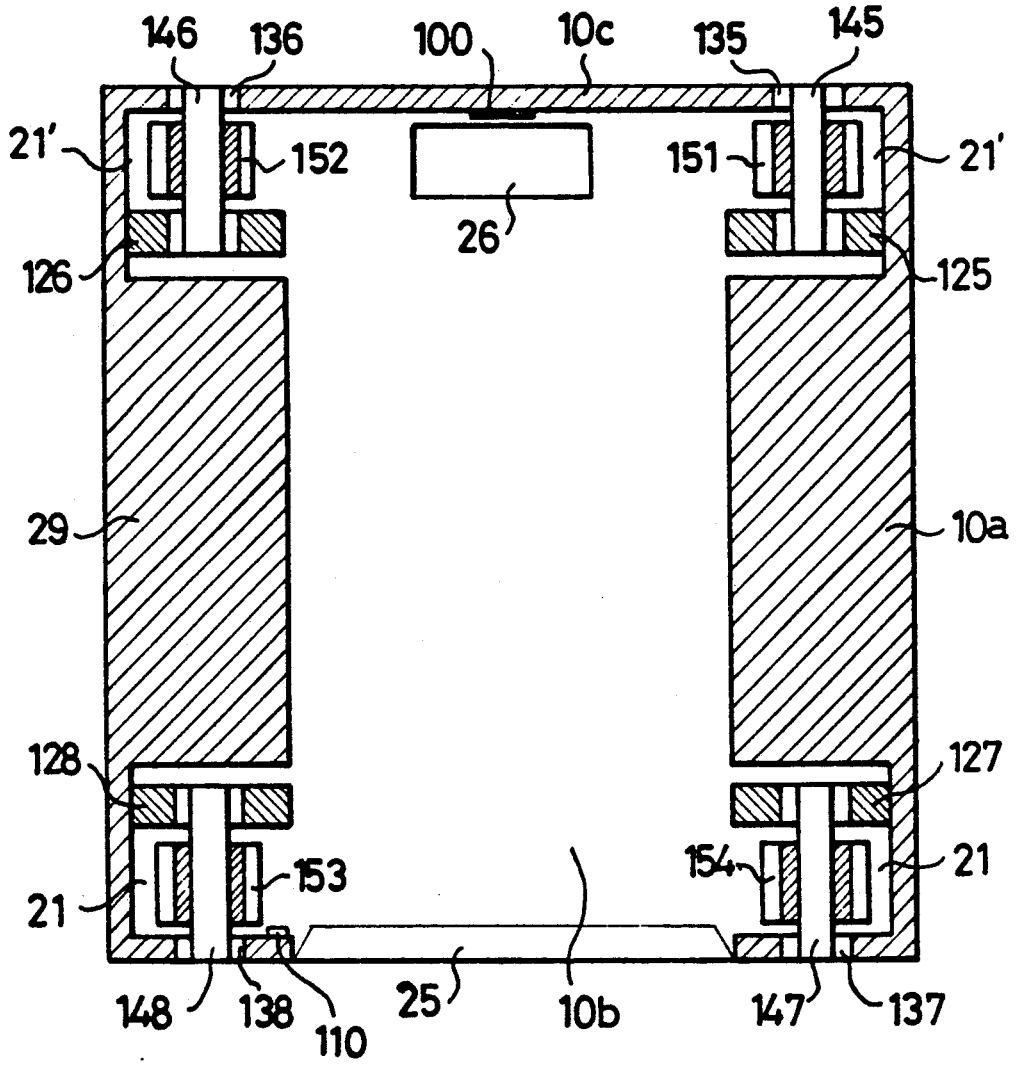
FIG. 1A is a cross-sectional view taken along line 1A in FIG. 1, showing a structure of a lower portion of the shoe closet.

The right compartment 20 is defined by a central plate 29 and a right plate **10*a* of the shoe closet 10. A gear box 23 is disposed at a top of the right compartment 20, constructing a right portion of a top plate of the shoe closet. Referring to FIGS. 1 and 1A, a first groove 21 is formed at a front (outer) edge of an inner wall of the right plate 10*a* and a first wall (not labeled) of the central plate 29 which faces the right plate 10*a*. Similarly, as shown in FIG. 1A, a second groove 21' is formed at a rear (inner) edge of the inner wall of the right plate 10*a* and at the first wall of the central plate 29. The grooves 21 and 21' extend along a height of the shoe closet 10. The grooves 21 and 21' receive conveyors of bookend type, i.e., objects to be conveyed are held between two parallel and synchronous conveyors of this type. And more particularly, the grooves 21 receives a pair of conveyors means which control downward movement of shoe-plate modules 40, and the grooves 21' receives another pair of conveyors means which control upward movement of the shoe-plate modules 40, which will be discussed in detail later. A plurality of pairs of transverse slots 22 are formed in the first wall of the central plate 29 and the inner wall of the right plate 10***a* and extend along a width of the shoe closet 10 (only the transverse slots in the first wall of the central plate 29 are shown). In addition, lower and front corners of the central plate 29 and the right plate 10*a* are both cut out to form a recess 24. A front edge 25 of a bottom plate 10*b* of the right compartment 20 is beveled for guiding the shoe-plate module to 40 enter the right compartment 20 (cf. FIG. 9), which will be discussed in detail later.

As can be seen in FIG. 1, the shoe-plate modules 40 according to the present invention for putting shoes thereon are substantially a drawer-like structure. Referring to FIG. 1A, a first switch means 110 for the activation of a downward movement of the shoe-plate modules 40 is provided on a peripheral wall of the groove 21 of the central plate 29 which faces a back plate 10*c* of the shoe closet 10. In addition, a second switch means 100 for the activation of an upward movement of the shoe-plate modules 40 is provided on the back plate 10*c*. The second switch means 100 is electrically connected to a relay 102, which is in turn electrically connected to a step motor 30 in the gear box 23.

Figure 2:
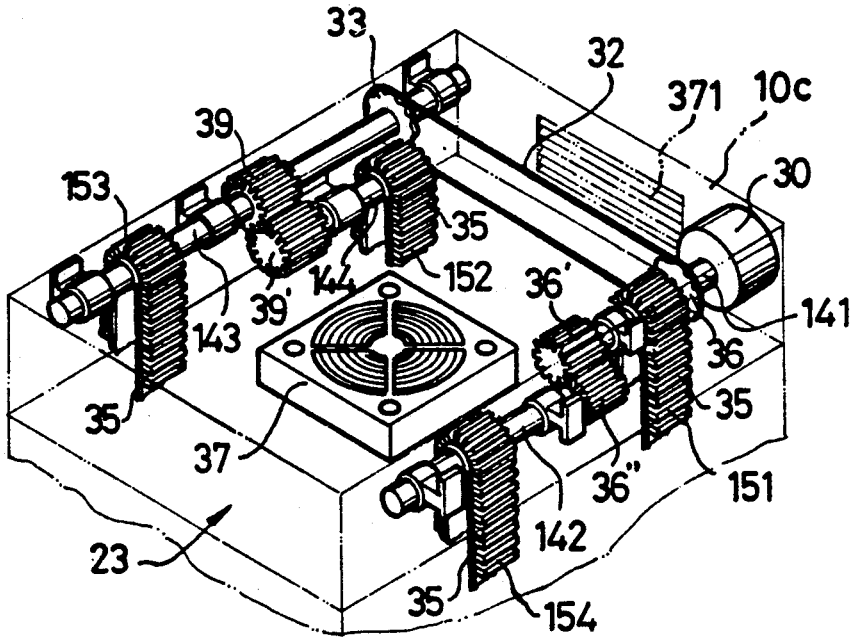
FIG. 2 is a perspective view of a gear box of the shoe closet in accordance with the present invention.
Figure 8:
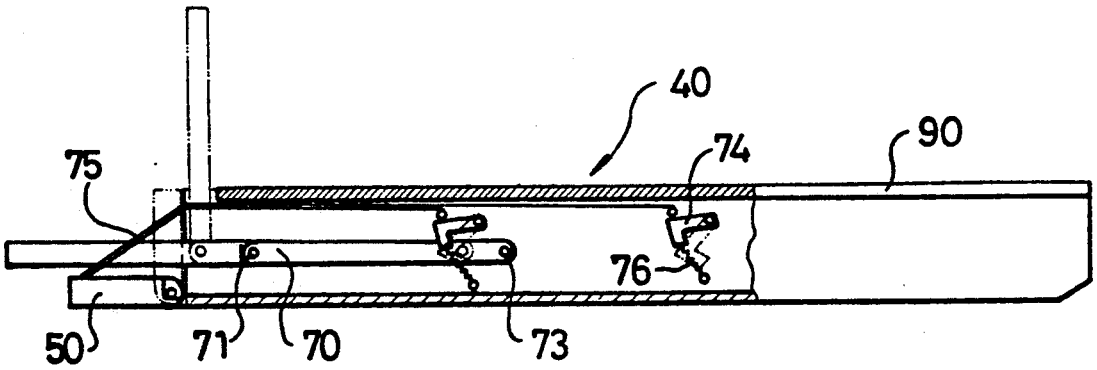
FIG. 8 is a schematic side view showing the operation of a front plate of the shoe-plate module.

Referring now to FIG. 2, the gear box 23 is disposed at a top of the shoe closet 10. The step motor 30 is secured to the back plate 10*c*. In this embodiment, the step motor 30 is adjacent to a right wall (not labeled) of the gear box 23. A first gear 36 and a second gear 36' are respectively mounted on a middle portion and a distal end of an output shaft 141 of the step motor 30. A second shaft 142 is rotatably mounted to the right wall of the gear box 23. A third gear 36" is mounted on the second shaft 142 and meshes with the second gear 36'. On a left wall (not labeled) of the gear box 23 a third shaft 143 is rotatably mounted. A fourth gear 33 is mounted on the third shaft 143 and mechanically connects to the first gear 36 via a chain 32. A fourth shaft 144 is rotatably mounted on the left wall of the gear box 23, and is drivable by the third shaft 143 by means of two gears 39 and 39' which are respectively mounted on the third shaft 143 and the fourth shaft 144. A fan 37 is provided for ventilating the whole shoe closet. In addition, a plurality of ventilating passages 371 are provided on the rear plate 10*c* of the shoe closet for ventilation.

FIG. 1A shows a structure of a lower portion of the conveyor means. A fifth shaft 145 is rotatably supported by a bearing 135 mounted on the rear plate 10*c* and by a support 125 mounted on the right plate 10*a*. A sixth shaft 146 is rotatably supported by a bearing 136 mounted on the rear plate 10*c* and by a support 126 mounted on the central plate 29. A seventh shaft 147 is rotatably supported by a bearing 137 and a support 127 mounted on the right plate 10*a*. And an eighth shaft 148 is rotatably supported by a bearing 138 and a support 128 mounted on the central plate 29.

Still referring to FIGS. 1A and further to FIG. 2, a first conveyor belt 151 is provided on the output shaft 141 and the fifth shaft 145. A second conveyor belt 152 is provided on the fourth shaft 144 and the sixth shaft 146. A third conveyor belt 153 is provided on the third shaft 143 and the eighth shaft 148. And a fourth conveyor belt 154 is provided on the second shaft 142 and the seventh shaft 147. The first and second conveyor belts 151 and 152 together constitute a first conveying means for upward movement of the shoe-plate module 40. The third and fourth conveyor belts 153 and 154 together constitute a second conveying means for downward movement of the shoe-plate module 40. The conveyor belts 151, 152, 153, and 154 are preferably made of rubber material.

Figure 3:
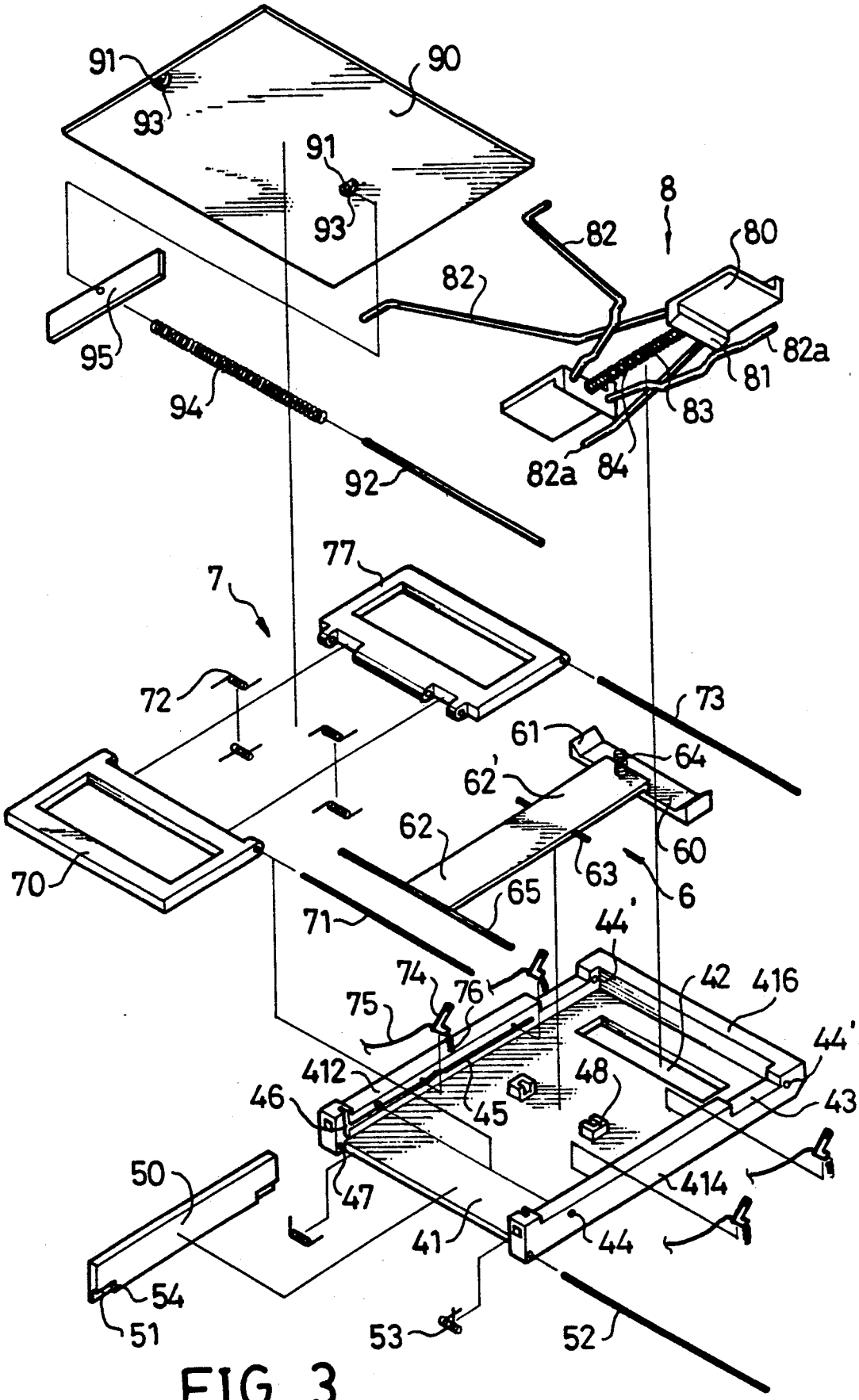
FIG. 3 is an exploded perspective view of a shoe-plate module in accordance with the present invention.

FIG. 3 shows an exploded perspective view of the shoe-plate module 40 according to the present invention. The shoe-plate module 40 is substantially of a box-like structure, including a bottom plate 41, a left side plate 412, a right side plate 414, a rear side plate 416, a front plate 70, and an upper plate 90 which has an upper side for shoes to be put thereon. On each of the left and right side plates 412 and 414 a groove 43 is formed adjacent to the rear side plate 416. An elongated slot 45 is formed on an inner surface of each of the left and right side plates 412 and 414 and extending along a length thereof. At a front end of the elongated slot 45, a vertical slot 46 is formed on the left and right side plates 412 and 414. Adjacent to a front edge of the left and right side plates 412 and 414 a hole 47 is formed for receiving a pivot shaft 52 to which a pivot plate 50 is mounted. A rod hole 44 is provided on the left and right side plates 412 and 414 adjacent to a front end thereof, through which an engaging member 82 is passable. Another hole 44' is provided on the left and right side plates 412 and 414 adjacent to a rear end thereof, through which another engaging member 82*a* is passable. An opening 42 is formed on the bottom plate 41 through which a control plate 60 is passable. At a middle portion of the bottom plate 41 a pair of spaced shaft seats 48 are disposed for receiving and retaining a rocker shaft 63 of an actuating assembly 6.

The pivot plate 50 has a notch portion 51 at an inner lower end thereof for the installation of return springs 53. In addition, the pivot plate 50 is channeled, such that the pivot shaft 52 is passable through the channel 54 in the pivot plate 50 and then mounted to the holes 47 in the left and right side plates 412 and 414 after the return springs 53 are mounted thereon. The pivot plate 50 has a width approximately the same but smaller than that of a front opening defined by the left and right side plates 412 and 414. Accordingly, the pivot plate 50 is pivotable about the pivot shaft 52, i.e., a user can manually pivot the pivot plate 50 outward, which is returned by the return springs 53 as soon as the pivot plate 50 is released.

Figure 4:
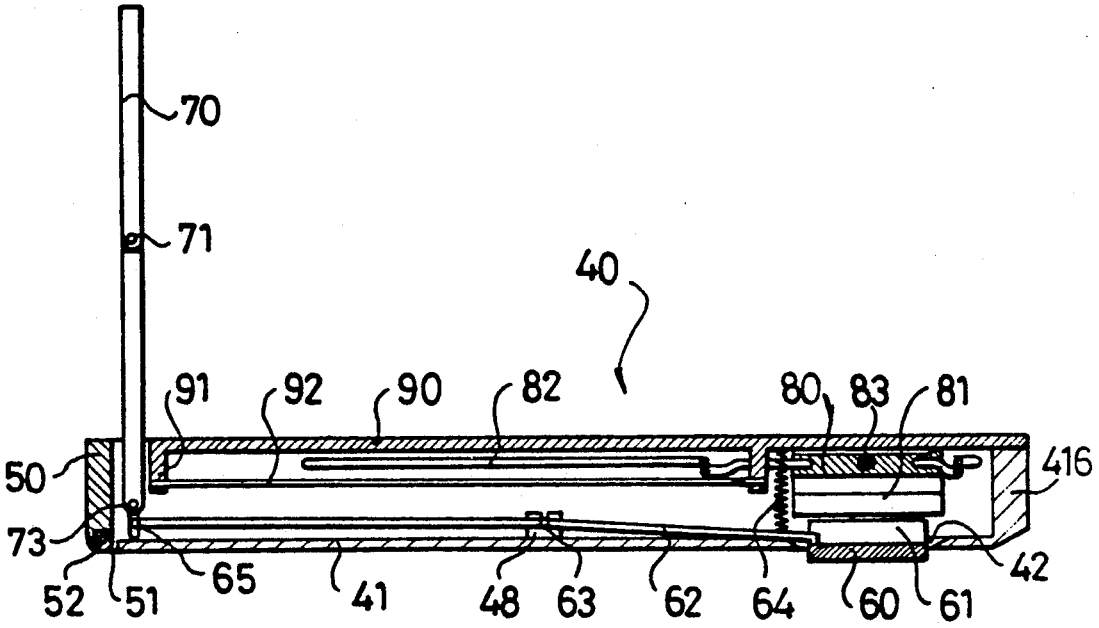
FIG. 4 is a side cross-sectional view of the shoe-plate module, wherein a control plate of the shoe-plate module is in a lower position.

The actuating assembly 6 includes a rocker plate comprising a first rocker plate 62, a second rocker plate 62', and a rocker shaft 63 therebetween. A control plate 60 is affixed to a distal end of the second rocker plate 62'; a spring 64 is mounted on an upper side of the second rocker plate 62' at the distal end thereof. The control plate 60 has two wedged-shaped end portions 61. A bar 65 is mounted to a distal end of the first rocker plate 62. As shown in FIG. 4, the rocker shaft 63 is mounted on the shaft seat 48 with the spring 64 contacting an underside of the upper plate 90, such that the control plate 60 is in a lower position when the rocker plate is not subjected to force.

Above the actuating assembly 6 is a front plate assembly 7 including a first front plate 70 and a second front plate 77 which are pivoted together by a front shaft 71. A plurality of springs 72 are provided on the front shaft 71 such that the first front plate 70 and the second front plate 77 are in alignment with each other when the front plate assembly 7 is not subjected to any external force. A rear shaft 73 is mounted to a distal edge of the second front plate 77. The rear shaft 73 is mounted in and slidable along the elongated slots 45 in the left and right side plates 412 and 414. Two pairs of hook/wire means are provided on the left and right side plates 412 and 414 to control the position of the front plate assembly 7 under cooperation of a pivot plate 50. Each hook/wire means includes a hook 74 attached to one of the left and right side plates 412 and 414 via a spring 76 at a first end thereof. A first end of a wire 75 is attached to a second end of the hook 74, and a second end of the wire 75 is attached to the pivot plate 50. Operation of the pivot plate 50 and the hook/wire means will be discussed in detail later.

Figure 6:
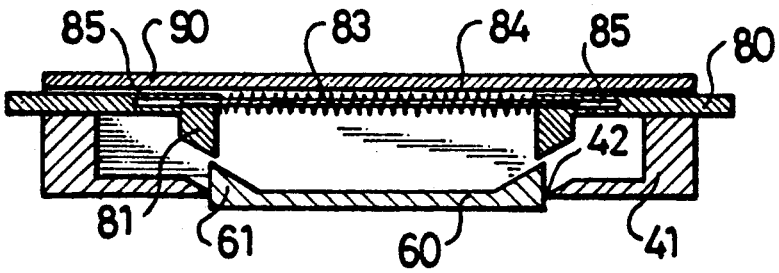
FIG. 6 is a cross-sectional view showing a connection relationship between the control plate and an engaging means, wherein the control plate is in the lower position.
Figure 7:
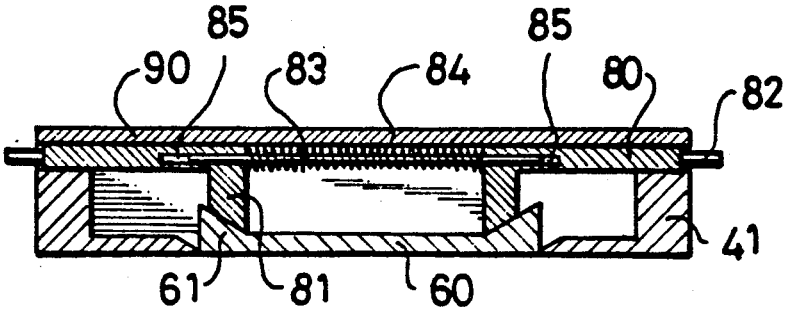
FIG. 7 is a cross-sectional view similar to FIG. 6, wherein the control plate is in the upper position to engage with the engaging assembly.
Figure 6A:
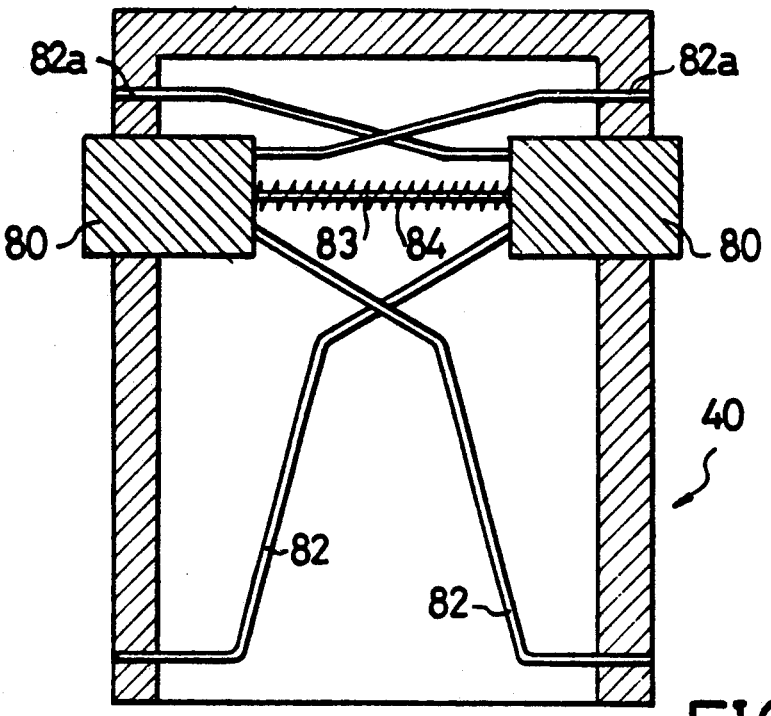
FIG. 6A is a schematic top view showing a position relationship between the control plate and the engaging means in FIG. 6.
Figure 7A:
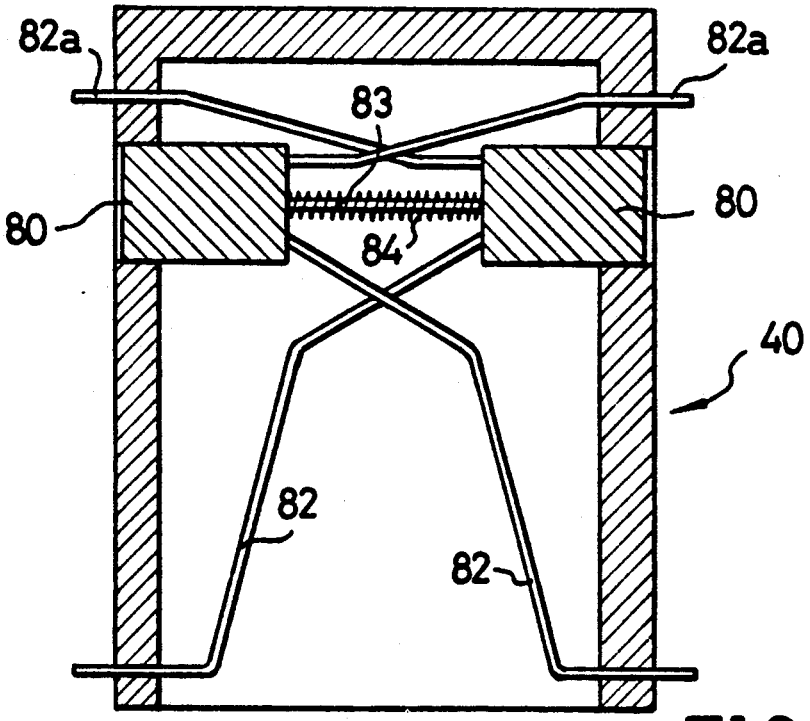

Referring now to FIGS. 3, 6, 6A, 7 and 7A, each shoe-plate module 40 further includes an engaging assembly 8, including two engaging plates 80 connected by a spring rod 83 on which a spring 84 is mounted. Each of the engaging plates 80 has a blind hole 85 for receiving the spring rod 83. Each of the engaging plates 80 further has a wedged portion 81 at an inner edge thereof for engagement with the wedged end portions 61 of the control plate 60. Each engaging plate 80 further has a first engaging member 82 protruding from the inner edge thereof, and a second engaging member **82*a* also protruding from the inner edge thereof As shown in FIGS. 6A and 7A, both the first engaging member 82 and the second engaging member 82*a* have a straight end portion for respectively passing through the holes 44 and 44' on the left and right side plates 412 and 414. As can be seen in FIGS. 6 and 6A, when the wedged end portions 61 of the control plate 60 does not engage with the wedged portions 81 of the engaging plates 80, the spring 84 is not compressed and the four engaging members 82 and 82*a* are in the shoe-plate module 40, while the two engaging plates 80 protrude outward to engage with the conveyor belts, such that the whole shoe-plate module 40 is held and carried by the conveyor belts. Referring to FIGS. 1 and 2, a plurality of spaced transverse members 35 are formed on an outer periphery of each conveyor belt 151, 152, 153, and 154, the engaging plates 80 of the shoe-plate module 40 engage with two adjacent transverse members 35 on the two spaced conveyor belts 151 and 152, or 153 and 154, such that the shoe-plate module 40 is held between said conveyor belts during upward and downward movement thereof. As shown in FIGS. 7 and 7A, when the wedged end portions 61 of the control plate 60 engage with the wedged portions 81 of the engaging plates 80, the spring 84 is compressed since the two engaging plates 80 are moved inward to be received in the shoe-plate module 40, and the four engaging members 82 and 82*a* respectively protrude outward through the holes 44 and 44' to engage with the slots 22 and 22', such that the whole shoe-plate module 40** disengages with the conveyor belts, which will be further discussed later.

Figure 9:
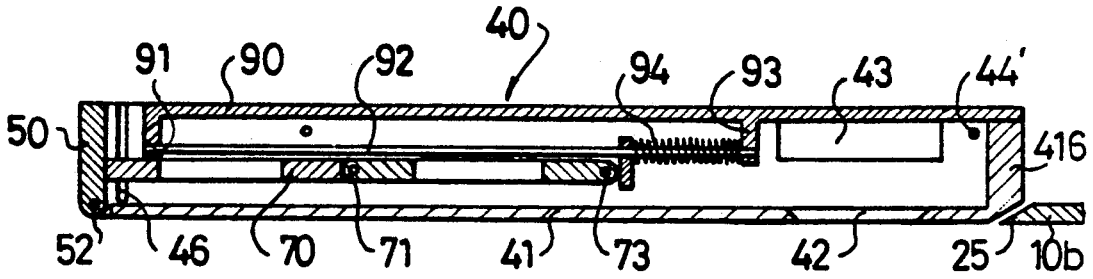
FIG. 9 is a side cross-sectional view of the shoe-plate module, wherein the front plate is received in the shoe-plate module.
Figure 10:
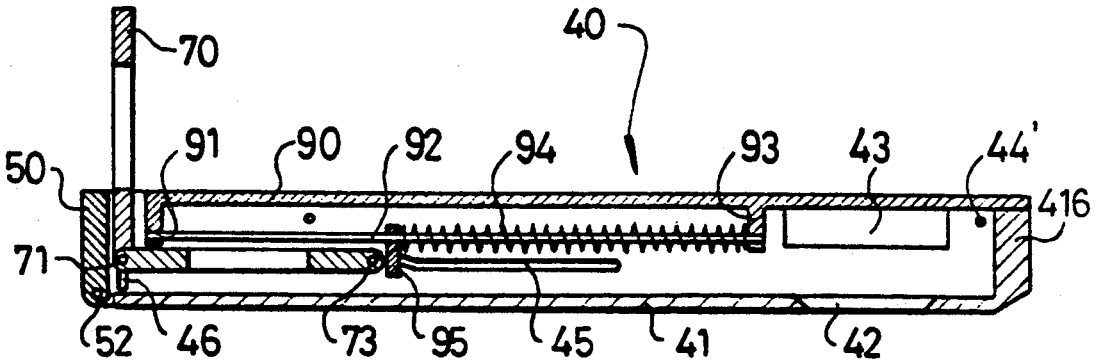
FIG. 10 is a view similar to FIG. 9, wherein half of the front plate is released from the shoe-plate module to an upright status.
Figure 11:
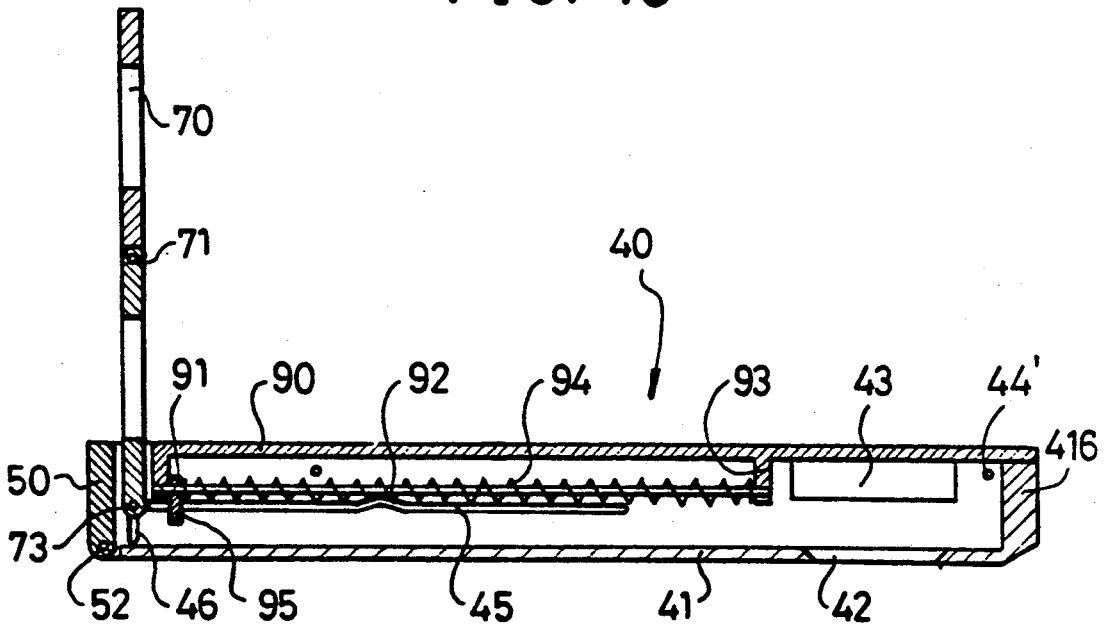
FIG. 11 is a view similar to FIG. 9, wherein the front plate is completely released from the shoe-plate module to an upright status.

The upper plate 90 of the shoe-plate module 40 has two spaced protrusions 93 formed on the underside thereof, each has a blind hole 91 facing each other for retaining a guiding shaft 92 therebetween. Referring to FIGS. 9 through 11, a spring 94 is provided on the guiding shaft 92 with a first end thereof attached to the protrusion 93 adjacent to the engaging plates 80, and a plate 95 is attached to a second end of the spring 94. The spring 94 and the plate 95 are provided for pushing the front plate assembly 7, which will be discussed in detail later.

Figure 5:
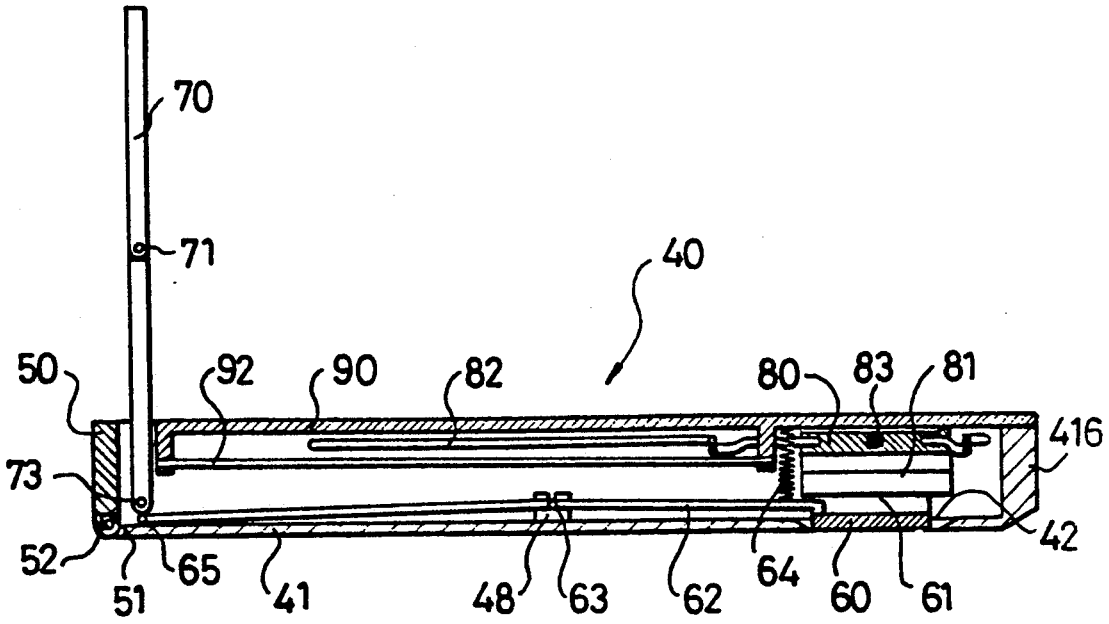
FIG. 5 is a view similar to FIG. 4, wherein the control plate of the shoe-plate module is in an upper position.

Referring now to FIGS. 4 and 5, in these two figures the front plate assembly 7 is completely in an upright position for shoes with a considerable height, such as boots. The spring 94 is omitted here for clarity. As can be seen in FIG. 4, the control plate 60 is in a lower position since the bar 65 is not depressed by the front plate assembly 7 (due to the force provided by spring 64). FIG. 5 shows that the control plate 60 is in an upper position since the bar 65 is depressed by the front plate assembly 7 (due to that the upper end of the front plate assembly 7, during upward movement of the shoe-plate module 40, contacts and is stressed by an under side of another shoe-plate module 40 disposed above this shoe-plate module 40). Alternatively, when the third and fourth conveyor belts 153 and 154 carry the shoe-plate module 40 downward to a bottommost position, such that the control plate 60 is against the bottom plate **10*b* of the shoe closet 10. Accordingly, the control plate 60** is urged upward to its upper position.

Operation

Referring back to FIGS. 1, and 1A, the shoe-plate module 40 in the storage compartment 20 is in a status shown in FIGS. 7 and 7A, i.e., the shoe-plate module 40 is retained in the compartment 20 by the engaging members 82 and **82*a* in the slots 22 and 22', and the control plate 60 is in its upper position since the front plate assembly 7 contacts another shoe-plate module 40** above it.

When the shoe-plate module 40 is pulled outward to a position completely out of the storage compartment 20, the shoe-plate module 40 is in a status shown in FIGS. 6 and 6A, the control plate 60 is in its lower position (since the front plate assembly 7 is not stressed), such that the engaging members 82 and **82*a* retract into the shoe-plate module 40 and the engaging plates 80 protrude outward to be held by the third and fourth conveyor belts 153 and 154. At the same time, one of the engaging plates 80 activates the first switch means 110, which in turn activates the step motor 30. The output shaft 141 of the step motor 30 turns in a manner such that the first and second conveyor belts 151 and 152 carry the held shoe-plate module 40 upward, and the third and fourth conveyor belts 153 and 154 carry the held shoe-plate module 40 downward. The step motor 30 turns for a pre-determined period of time, for example, 10 seconds, sufficient for the shoe-plate module 40 to move from an uppermost position to a bottommost position in the shoe closet 10**.

When the shoe-plate module 40 is carried by the third and fourth conveyor belts 153 and 154 to the bottommost position, the shoe-plate module 40 contacts the bottom plate **10*b* of the shoe closet 10, such that control plate 60 is urged to its upper position to make the engaging plates 80 disengage with the third and fourth conveyor belts 153 and 154. The user may take the shoes on the shoe-plate module 40 during downward movement of the shoe-plate module 40 or may wait until the shoe-plate module 40** reaches the bottommost position.

Thereafter, the user may push the empty shoe-plate module 40 inward until the control plate 60 is again in its lower position due to the provision of the groove 26 provided on the bottom plate 26 of the shoe closet 10. Accordingly, the engaging plates 80 engage with the first and second conveyor belts 151 and 152. At the same time, the shoe-plate module 40 activates the second switch means 100 and the relay 102, which in turn activates the step motor 30. The shoe-plate module 40 is carried upward by the first and second conveyor belts 151 and 152 until the upper edge of the front plate assembly 7 contacts another shoe-plate module 40 stored above the moving shoe-plate module 40. When the upper edge of the front plate assembly 7 is stressed, the control plate 60 is urged to its upper position, the engaging plates 80 disengage with the first and second conveyor belts 151 and 152, and the engaging members 82 and 82*a* protrude outward to contact and to be hung by the slots 22 and 22'. Accordingly, the shoe-plate module 40 is no longer carried by the first and second conveyor belts 151 and 152. Due to the provision of the relay 102, the step motor 30 turns for a pre-determined period of time after the second switch means 100 is activated. Again, the pre-determined period of time is sufficient for the first and second conveyor belts 151 and 152 to carry a shoe-plate module 40 from the bottommost position to the uppermost position.

The user may put the shoes to be stored on the shoe-plate module 40 and push the shoe-plate module 40 inward to make it held and carried by the first and second conveyor belts 151 and 152, in which the subsequent operation thereof is the same as that mentioned in the above paragraph.

Please refer to FIGS. 8 through 11. FIG. 9 shows that the front plate assembly 7 is received in the shoe-plate module 40. If a pair of shoes to be stored has a small height, such as sandals, the user may pivot the pivot plate 50 outward such that the first front plate 70 ejects outward by the spring 94 to a status shown in FIG. 10. This is because the wires 75 are pulled outward by the pivot plate 50 to urge the hooks 74, such that the front shaft 71 and the rear shaft 73 disengage with the hooks 74, allowing the compressed spring 94 to expand. Similarly, if the pair of shoes to be stored has a considerable height, such as boots, the user may pivot the pivot plate 50 outward such that the first and second front plate 70 and 77 eject outward by the spring 94 to a status shown in FIG. 11. Again, this is because the wires 75 are pulled outward by the pivot plate 50 to urge the hooks 74, such that the front shaft 71 and the rear shaft 73 disengage with the hooks 74, allowing the compressed spring 94 to expand.

While the present invention has been explained in relation to its preferred embodiment, it is to be understood that various modifications thereof will the apparent to those skilled in the art upon reading this specification. Therefore, it is to be understood that the invention disclosed herein is intended to cover all such modifications as fall within the scope of the appended claims.

I claim:

1. A shoe closet comprising:

a compartment defined by a right plate, a left plate, a top plate, a rear plate, and a bottom plate; a plurality of pairs of slots being formed in said right and left plates, said slots paralleling each other and extending along a width of said shoe closet;

a plurality of shoe-plate modules for putting shoes therein;

a conveyor assembly comprising:

a first conveyor means disposed at an inner edge of said compartment for an upward movement of said shoe plate modules; and a second conveyor means disposed at an outer edge of said compartment for a downward movement of said shoe-plate modules;

a driving means for driving said first and second conveyor means; and a first switch means electrically connected with said driving means and activatable by said shoe-plate modules for activating said second conveyor means to carry said shoe-plate modules downward when said shoe-plate modules are pulled out from said compartment;

a second switch means electrically connected with said driving means and activatable by said shoe-plate modules for activating said first conveyor means to carry said shoe-plate modules upward to a storage position when said shoe-plate modules are pushed inward into said compartment;

each said shoe-plate module including an engaging means, said engaging means engaging with said second conveyor means, such that said shoe-plate module is held and carried by said second conveyor means during the downward movement thereof, said engaging means disengaging with said second conveyor means when said shoe-plate module reaches said bottom plate;

said engaging means of said shoe-plate module engaging with said first conveyor means such that said shoe-plate module is held and carried by said first conveyor means during the upward movement thereof, and said engaging means disengaging with said first conveyor means when said shoe-plate module reaches a storage position;

each said shoe-plate module having a pair of engaging members which are received in said shoe-plate module when said engaging means engages with said conveyor assembly, said engaging members protruding outward into one pair of said slots for retaining said shoe-plate module when said shoe-plate module reaches the storage position; and each said shoe-plate module further including a front plate having a means for adjusting the height of the front plate for shoes of various height; said engaging members being actuated to protrude outward into said pair of slots when an upper edge of said front plate contacts a lower side of another shoe plate module located above said shoe-plate module.

2. The shoe closet as claimed in claim 1, wherein a front edge of said bottom plate is beveled to guide said shoe-plate module to enter said compartment.

3. The shoe closet as claimed in claim 2, wherein said shoe-plate module is beveled at a rear bottom side thereof for matching with the beveled front edge of said bottom plate of said shoe closet.

4. The shoe closet as claimed in claim 1, wherein each of said first and second conveyor means includes two spaced conveyor belts having a plurality of spaced transverse members formed on an outer periphery thereof, said engaging means of said shoe-plate module engages with two adjacent transverse members on said two spaced conveyor belts, such that said shoe-plate module is held between said conveyor belts during upward and downward movement thereof.

5. The shoe closet as claimed in claim 1, further comprising a fan for ventilation.

6. The shoe-closet as claimed in claim 1, further comprising a plurality of ventilating passages provided on said shoe closet for ventilation.

7. The shoe-closet as claimed in claim 1, further comprising a second compartment for storage of slippers, a door being hinged to the shoe closet to open and close said second compartment, a plate being slidably received in said second compartment, and a foldable slipper shelf being hinged to an inner side of said door at a first end thereof and being hinged to an inner side of said plate at a second end thereof, said plate being slidable along a depth direction of said second compartment.

* * * * *